US006080966A

United States Patent [19]

Mallinger et al.

[11] Patent Number: 6,080,966

[45] Date of Patent: Jun. 27, 2000

[54] OVEN MUFFLE WITH THERMAL INSULATION

[75] Inventors: Peter Mallinger, Traunreut; Klemens Roch, Trostberg, both of Germany

[73] Assignee: BSH Bosch und Siemens Hausgeraete GmbH, Munich, Germany

[21] Appl. No.: 09/395,318

[22] Filed: Sep. 13, 1999

[30] Foreign Application Priority Data

Sep. 15, 1998 [DE] Germany ..... 198 42 247

[51] Int. Cl.[7] ..... A21B 1/02; A21B 3/00; F24C 15/34

[52] U.S. Cl. ..... 219/405; 219/391; 219/399; 126/19 R

[58] Field of Search ..... 219/402, 405, 219/406, 408, 391, 399; 126/19 R, 273 R, 275 E; 432/250, 251

[56] References Cited

U.S. PATENT DOCUMENTS 3,782,360 1/1974 Brucken ..... 126/19 R
4,880,952 11/1989 Hirai et al. ..... 126/275 E

FOREIGN PATENT DOCUMENTS 4028743 3/1992 Germany .

*Primary Examiner*—Joseph Pelham
*Attorney, Agent, or Firm*—Herbert L. Lerner; Laurence A. Greenberg; Werner H. Stemer

[57] ABSTRACT

An oven muffle has mutually spaced apart inner and outer insulating walls. An insulation layer composed of particulate material is disposed in an interstice between the inner and the outer insulating walls. At least one of the insulating walls is pretensioned toward the respective other insulating wall in order to exert a permanent pressure on the insulation layer.

9 Claims, 2 Drawing Sheets

OVEN MUFFLE WITH THERMAL INSULATION

BACKGROUND OF THE INVENTION

Field of the Invention

The invention relates to an oven muffle having an insulation layer contained in an interstice provided between two insulating walls.

In the following, the term oven muffle is to be generally understood as a muffle of any household appliance which requires insulation. For thermal insulation of oven muffles, glass wool or mineral wool fibers are conventionally used. However, these glass wool or mineral wool fibers are increasingly being replaced for health and safety reasons. Granulates, as used for instance in accordance with Published German Patent Applications DE 40 28 743 A1 or DE 195 29 040 A1 in oven muffles of the type defined above, have the tendency of being compressed or reduced in size during use of the oven muffle. This is caused by motions of the muffle wall and the outer wall defining the muffle wall. These motions are due to temperature changes and cause a loss of volume of the insulation material which results in poor insulating properties.

As alternatives, organic binding agents, the use of which should however be avoided, or the use of mats or slabs of composite material, which may include foils, foam and the like, has been suggested for instance in accordance with Published German Patent Application DE 44 38 294 A1.

SUMMARY OF THE INVENTION

It is accordingly an object of the invention to provide a thermal insulation for an oven muffle which overcomes the above-mentioned disadvantages of the heretofore-known thermal insulations of this general type and which is fiber-free and free of binding agents and has good insulation properties.

With the foregoing and other objects in view there is provided, in accordance with the invention, an oven muffle, comprising an inner insulating wall; an outer insulating wall spaced apart from the inner insulating wall for forming an interstice between the inner and outer insulating walls; at least a part of at least one of the insulating walls being pretensioned toward a respective other one of the insulating walls; and an insulation layer formed of particulate material disposed in the interstice.

In accordance with another feature of the invention, the outer insulating wall at least partly encloses an oven space and is pretensioned in a direction toward the oven space.

In the oven muffle of the invention, the insulation layer is thus composed of particulate material and is contained in an interstice provided between two insulating walls. One or both insulating walls are prestressed or pretensioned toward the respective other insulating wall.

This provision according to the invention has the effect that the particles of the insulation layer are kept in their position by the inner and/or outer insulating wall even in the event of temperature changes, because of the imposition of pressure. Furthermore, an unhindered expansion of the muffle walls is still guaranteed, so that there are no increased mechanical strains on the housing. In this way, it is possible to achieve that the volume of the insulation layer is maintained, and the insulation properties are maintained on all sides.

The pretensioning of the outer insulating wall and/or the inner insulating wall is advantageously achieved by providing it with shaped impressions in its surfaces. These shaped impressions allow a slaved motion of the insulating wall in response to temperature changes, but at the same time cause a slight pressure to be exerted on the thermal insulating material located in the interior.

Further, the outer insulating wall and/or the inner insulating wall can comprise outward- or inward-bowed plates, which makes production especially simple.

In accordance with another feature of the invention, the inner and/or outer insulating walls have a concave or convex shape for generating a pressure on the material of the insulation layer disposed in the spacing between the inner and outer insulating walls.

It is in particular expedient to provide the inner insulating wall also as a muffle wall, so that no additional housing except for the outer insulating wall has to be provided. The bottom heating heater unit with its associated outer wall or its housing drawer is expediently disposed directly below the muffle bottom, in other words above the lower insulation layer.

In the case of a pyrolysis appliance, the two insulating walls according to the invention form their own internal housing, such that even at maximum expansion of the muffle wall in response to temperature, no warping occurs. The bottom heating heater unit with the associated outer wall or housing is in this case expediently inserted between the muffle bottom and the inner insulating wall. It is understood that the necessary leadthroughs for the bottom heating heater unit, top heating heater unit, lighting, etc. are provided.

Examples of materials that can be used for insulation are in particular perlites, diatomaceous earth, swelling clay, etc. However, this list is not exhaustive. Regarding the shapes of the filling materials, balls or beads are especially suitable, but other forms of granulate, such as coarse powder, are also possible.

Other features which are considered as characteristic for the invention are set forth in the appended claims.

Although the invention is illustrated and described herein as embodied in an oven muffle with thermal insulation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
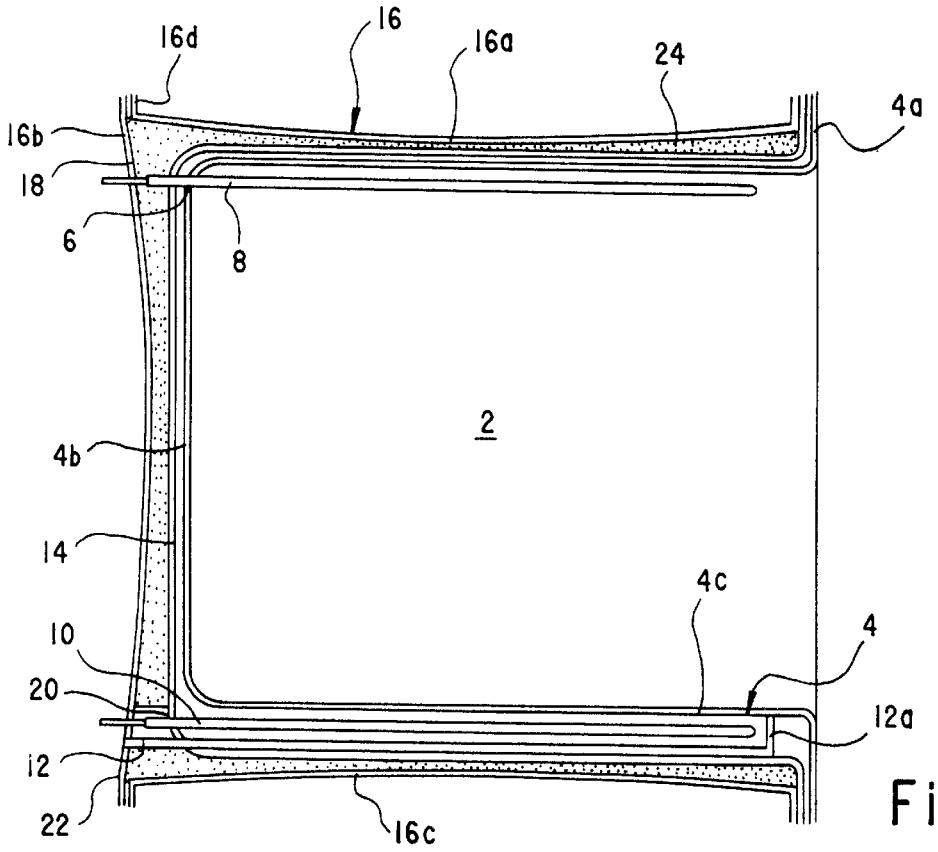
FIG. 1 is a cross-sectional view of an oven muffle with thermal insulation for a pyrolysis appliance in accordance with a first exemplary embodiment of the invention.

Referring now to the figures of the drawings in detail and first, particularly, to FIG. 1 thereof, there is shown an oven muffle 2 with a muffle wall 4. The muffle wall 4 is bent away (see reference numeral 4*a*) on the front of the oven to form the front wall. The muffle wall 4 has typical leadthroughs or ducts. In FIG. 1, one leadthrough 6 is shown for a top heating heater unit 8 in the back wall 4*b* of the muffle. A bottom heating heater unit 10 with an associated bottom heating outer wall 12, which rests with its front wall 12*a* on the muffle bottom 4*c*, is disposed under the muffle bottom 4*c*.

The muffle wall 4 is surrounded by a double insulating wall 14, 16. An inner insulating wall 14 with leadthroughs 18, 20, 22 for the top heating heater unit, bottom heating heater unit and bottom heating outer wall, surrounds the muffle wall 4 with an essentially constant spacing, in such a way that the muffle wall can expand in response to temperature. An outer insulating wall 16 is formed, in the present exemplary embodiment, in multiple parts of various plates, of which in FIG. 1 the top wall plate 16*a*, back wall plate 16*b* and bottom wall plate 16*c* are shown. The outer plates 16*a*, 16*b*, and 16*c* all have upward- or downward-pointing peripheral flanges or regions 16*d* for mounting purposes. In the exemplary embodiment shown, the outer plates 16*a*, 16*b* and 16*c* are pretensioned inward, and specifically are bowed in the direction of the oven muffle 2. Thus, because of their shape and tension, the plates exert a constant inward-oriented pressure, which is essentially independent of any occurring temperature changes or temperature fluctuations. Between the inner and outer insulating walls 14, 16, there is an insulation layer 24, which, in the exemplary embodiment, is composed of perlite beads. Due to the pressure generated by the outer plates 16*a*, 16*b*, and 16*c*, the perlite beads are kept in their position, even when temperature changes occur, specifically with only a slight but constantly exerted pressure. Even when this perlite bead structure ages and if there are any reductions in size, disintegration, crumbling, or, in other words when the perlite beads settle, these beads are always kept fixed as a consequence of the pressure imposed by the outer insulating wall 16, so that even over relatively long times in service, the insulating properties can be maintained on all sides.

In FIG. 1, the layer thickness of the insulation layer is reduced in the upper region, which is made possible, in the present construction, by cooling air channels above the insulation layer. Of course the layer thickness in the upper region may also be the same as in the other regions.

Figure 2:
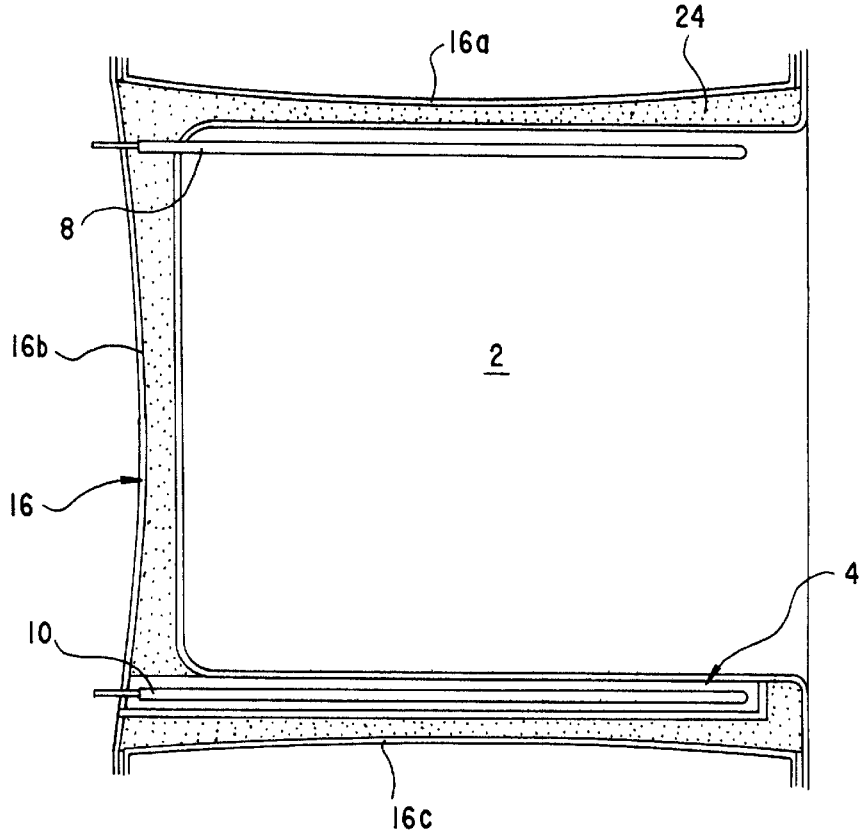
FIG. 2 is a cross-sectional view of an oven muffle with thermal insulation in accordance with a second exemplary embodiment of the invention.

FIG. 2 shows a second exemplary embodiment of the oven muffle of the invention. The oven muffle shown in FIG. 2 is for an oven without a pyrolysis mode. Elements of the oven muffle in FIG. 2 that are the same as those of the exemplary embodiment described above are designated by the same reference numerals and will not be described again. The construction of the oven muffle 2 and its insulation are substantially as described above. However, here the two insulating walls do not form a separate housing, but instead the muffle wall 4 forms at the same time the inner insulating wall. The outer insulating wall 16 again comprises individual plates 16*a*, 16*b*, and 16*c*, which are again pretensioned inward by being bowed, in order to provide a permanent compensation for compaction and a loss of volume of the insulation layer 24.

Figure 3:
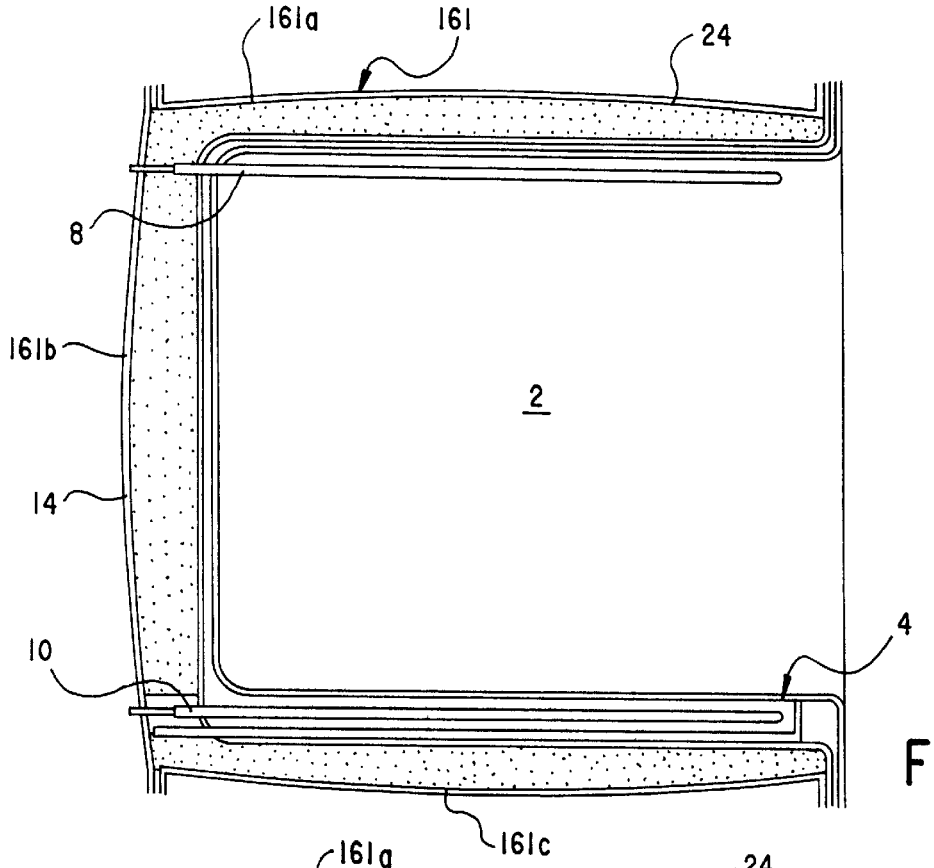
FIG. 3 is a cross-sectional view of an oven muffle with thermal insulation for a pyrolysis appliance in accordance with a third exemplary embodiment of the invention.

The third exemplary embodiment shown in FIG. 3 of the oven muffle of the invention again pertains to an appliance with a pyrolysis mode. It differs substantially from the exemplary embodiment of FIG. 1 in the outwardly bulged curvature of the outer plates 161*a*, 161*b*, 161*c*, wherein this outward bulging or bowing again exerts an inward-oriented pressure on the insulation layer 24.

Figure 4:
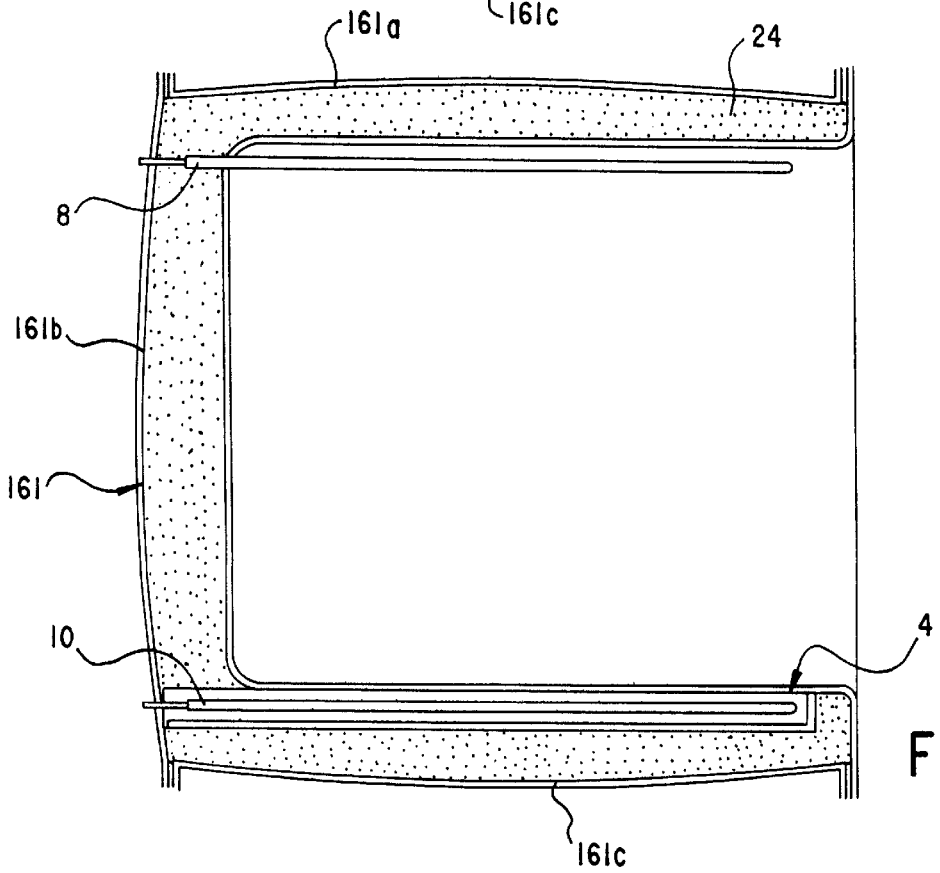
FIG. 4 is a cross-sectional view of an oven muffle with thermal insulation in accordance with a fourth exemplary embodiment of the invention.

In FIG. 4, a fourth exemplary embodiment of an oven muffle of the invention for an appliance without pyrolysis is shown. Like the third exemplary embodiment, it has an outer insulating wall 161 with outward-bowed plates 161*a*, 161*b*, and 161*c*, which exert an inward-oriented pressure on the insulation layer 24. Instead of this bowing of the kind shown in the above-described four exemplary embodiments, the inner and/or the outer insulating wall can alternatively or additionally have shaped impressions or embossed features of arbitrary type. Through the use of such a shaping, the necessary pressure is then exerted upon the insulation layer or its particles.

We claim:

1. An oven muffle, comprising:

an inner insulating wall;

an outer insulating wall spaced apart from said inner insulating wall for forming an interstice between said inner and outer insulating walls;

at least a part of one of said insulating walls being pretensioned toward a respective other one of said insulating walls; and an insulation layer formed of particulate material disposed in said interstice.

2. The oven muffle according to claim 1, wherein said outer insulating wall encloses an oven space and is pretensioned in a direction toward said oven space.

3. The oven muffle according to claim 1, wherein said inner insulating wall has a surface formed with shaped impressions.

4. The oven muffle according to claim 1, wherein said outer insulating wall has a surface formed with shaped impressions.

5. The oven muffle according to claim 1, wherein said outer insulating wall is formed of outward-bowed plates.

6. The oven muffle according to claim 1, wherein said outer insulating wall is formed of inward-bowed plates.

7. The oven muffle according to claim 1, wherein said inner insulating wall is a muffle wall enclosing an oven space.

8. The oven muffle according to claim 7, wherein said muffle wall has a muffle bottom, and further including a bottom heating heater unit with an associated bottom heating outer wall inserted between said muffle bottom and said insulation layer.

9. The oven muffle according to claim 1, including:

a muffle wall enclosing an oven space and having a muffle bottom, said muffle wall being provided separate from said inner insulating wall; and a bottom heating heater unit with an associated bottom heating outer wall inserted between said muffle bottom and said inner insulating wall.

* * * * *